United States Patent [19]

Frank, Jr.

[11] Patent Number: 4,471,159

[45] Date of Patent: Sep. 11, 1984

[54] ELECTRICAL CONNECTOR AND METHOD OF MAKING AN ELECTRICAL CONNECTION

[75] Inventor: Walter J. Frank, Jr., Darien, Conn.

[73] Assignee: Burndy Corporation, Norwalk, Conn.

[21] Appl. No.: 381,278

[22] Filed: May 24, 1982

[51] Int. Cl.[3] ..... H01R 11/09; H01R 15/00

[52] U.S. Cl. ..... 174/94 R; 29/525; 339/246; 403/389; 411/452

[58] Field of Search ..... 174/94 R, 94 S; 339/246; 403/389, 390, 391; 411/71, 73, 451, 452; 228/115, 116; 29/525

[56] References Cited

U.S. PATENT DOCUMENTS

| | | | |
|---|---|---|---|
| 2,092,372 | 9/1937 | Goeller | 173/263 |
| 2,130,825 | 9/1938 | Bergan | 339/242 R X |
| 2,680,774 | 6/1954 | Hoffman et al. | 174/94 |
| 3,115,541 | 12/1963 | Hanner et al. | 174/92 |
| 3,135,572 | 6/1964 | Curtis et al. | 339/198 |
| 3,235,944 | 2/1966 | Broske et al. | 29/155.5 |
| 3,240,100 | 3/1966 | Rose | 411/452 |
| 3,248,684 | 4/1966 | Hubbard et al. | 339/246 |
| 3,434,103 | 3/1969 | Hancock et al. | 339/272 |
| 3,661,406 | 5/1972 | Mele | 287/189.36 F |
| 4,012,884 | 3/1977 | Pagel | 411/452 |
| 4,147,446 | 4/1979 | Frank | 403/390 |
| 4,293,176 | 10/1981 | Lindlof | 339/246 |

FOREIGN PATENT DOCUMENTS

| | | | |
|---|---|---|---|
| 226028 | 12/1959 | Australia | 174/94 S |
| 193455 | 11/1957 | Fed. Rep. of Germany | 174/94 S |
| 2808158 | 8/1979 | Fed. Rep. of Germany | 411/452 |

*Primary Examiner*—John Gonzales
*Assistant Examiner*—Morris H. Nimmo
*Attorney, Agent, or Firm*—Howard S. Reiter

[57] ABSTRACT

An electrical connector and method of making an electrical connection for reliably supporting conductors with a high retention force. The connector has two conductor-engaging members joined through a pin making an interference fit with and bonding itself to at least one member. The pin contains grooves and lands on its surface which are permanently altered as the pin is pressed or fired into the conductor engaging member to provide a strong, high retention force cold welded connection.

22 Claims, 4 Drawing Figures

ELECTRICAL CONNECTOR AND METHOD OF MAKING AN ELECTRICAL CONNECTION

BACKGROUND OF THE INVENTION

This invention generally relates to an electrical connector and method of making an electrical connection and, more particularly, to an electrical connector that can be installed very quickly and reliably maintains a retention force on the conductor during long periods of operation.

It is frequently necessary to join electrical conductor cables together, especially in utility applications, and then pass high current and high voltage across the connection. The connectors used are required to be strong, and oftentimes are subjected to high temperature, excessive vibrations and other adverse operating conditions. In addition, the installation of such connectors often must take place in the field or in awkward or crowded areas where a quick and easy installation is favored.

It is generally desired to maintain the electrical resistance across a connector device at as low a value as practical. Resistance is normally kept at a level equal to or lower than an equivalent unbroken conductor. It is also important to maintain the resistance value in a stable manner over a variety of adverse operating conditions for a long period of time. Other important considerations for such connections are the mechanical strength of the connection, the time taken to make the connection and the amount of material used in the connector device.

One prior art device commonly used for this type of electrical connection is a cap and body connector which is held together by a nut and bolt arrangement. The conductors are first placed between the cap and body. The bolt then is placed through an opening in the cap and body and the nut is screwed on the bolt and tightened down onto the cap. Tightening is continued to a predetermined degree to compress the cap and body onto the cables. As the compression force is increased on the cables during the tightening process, the electrical resistance across the connection is lowered to a level determined by the geometry of the device. Devices in the prior art which disclose connectors of this type are described in U.S. Pat. No. 3,248,684 to Hubbard et al and in German Pat. No. 193,455 to Schrauben.

One problem with the nut and bolt arrangement is that during operation of the electrical connector, heat build-up can cause an expansion of the various parts of the connector and a relaxation of the retention force placed on the conductors thereby. Such relaxation can be sufficient to cause an irreversible loosening of the connector. This, in turn, causes the electrical resistance to increase and the connector can lose efficiency. The possibility of this relaxation occurring, which may also be caused by vibration as well as other factors, is heighted when different materials are used within the connector. For instance, it is common to use aluminum caps and bodies that are held together with steel nuts and bolts. In addition, the torque applied to the nut during the original tightening process may vary from connector to connector because of hand tightening, different installers etc., further reducing the assurance that such connectors will operate in the manner intended.

Another commonly used prior art device is the wedge-type connector for joining conductors. This two-piece device has an outer shell and an inner wedge.

The shell is generally made to taper in conformance with the angle of the wedge. Cables are placed in the shell, and the wedge placed therebetween and driven into the cable/shell arrangement for a snug fit. This type of device uses a relatively large amount of material and is not an easy one to assemble, especially in the field or in cramped locations. It is also quite limited in terms of the range of conductor sizes that each connector can accommodate. This type of connector is disclosed in U.S. Pat. No. 3,235,944 to Broske et al.

Still another type of electrical wiring connector, usually used for joining much smaller conductors than those employed in the utility field, is made of nonconductive, semi-flexible plastic material. This prior art device makes a connection between two insulated wires without the necessity of first removing the insulation from the wires. The device is made of two identical halves, each half having a stud and a hole to receive the stud. The studs have concentric ribs which snap into the holes when the two halve are placed together face-to-face. Because of the resilience of the material, the studs can be forced into the holes until they pop out the other side allowing the ribs to assume their original shape and hook over the outer surface of the connector. Such connectors have the drawbacks of relatively low retention force because of the resiliency of the material used and possible instability due to high temperatures. They also require special conductors embedded therein to pass the current. U.S. Pat. No. 3,115,541 issued to Hanner et al discloses a connector of this type.

Electrical terminals are also known which have connector screw structures attached to a terminal block by a pin pressed into the block. U.S. Pat. No. 3,135,572 to Curtis et al discloses such a terminal. In addition, general use mechanical fasteners are known which have a plurality of concentric lands on their shafts which, as they are being driven into the material being fastened, urge the material to flow into the spaced regions between the lands. A mechanical fastener of this type is disclosed in U.S. Pat. No. 3,661,406 to Mele.

Accordingly, it is an object of the present invention to provide an improved connector device which reliably maintains a high retention force on the conductors.

It is another object of the invention to provide an improved connector device which, upon assembly, places a uniform retention force on the conductors.

It is another object of the invention to provide an electrical connector which is relatively quick and easy to install.

It is another object of th invention to provide an electrical connector which maintains a relatively low connector resistance level under adverse operating conditions over a long duration.

It is another object of the invention to provide an electrical connector device which uses less materials for the retention force placed on the connector.

It is another object of the invention to provide an electrical connector for utility applications which is smaller than the prior art device.

It is another object of the invention to provide a strong electrical connector device.

It is another object of the invention to provide an electrical connector device that can accommodate a relatively large range of conductor sizes.

SUMMARY OF THE INVENTION

Briefly, stated, and in accordance with the present invention, there is provided an electrical connector device which holds the connector and conductor together with a strong retention force after installation. The connector includes conductor engaging members held together by pin means. The pin means is inserted into apertures in the members with at least one member having an interference fit therewith and bonding itself thereto. In one embodiment, the surface of the pin means contains lands which enhance the bonding process with the connector member as the pin is pressed or fired into the member during installation.

BRIEF DESCRIPTION OF THE DRAWINGS

Other objects and advantages of the invention will become apparent upon reading the following detailed description with reference to the following drawings wherein.

DETAILED DESCRIPTION OF THE INVENTION

Figure 1:
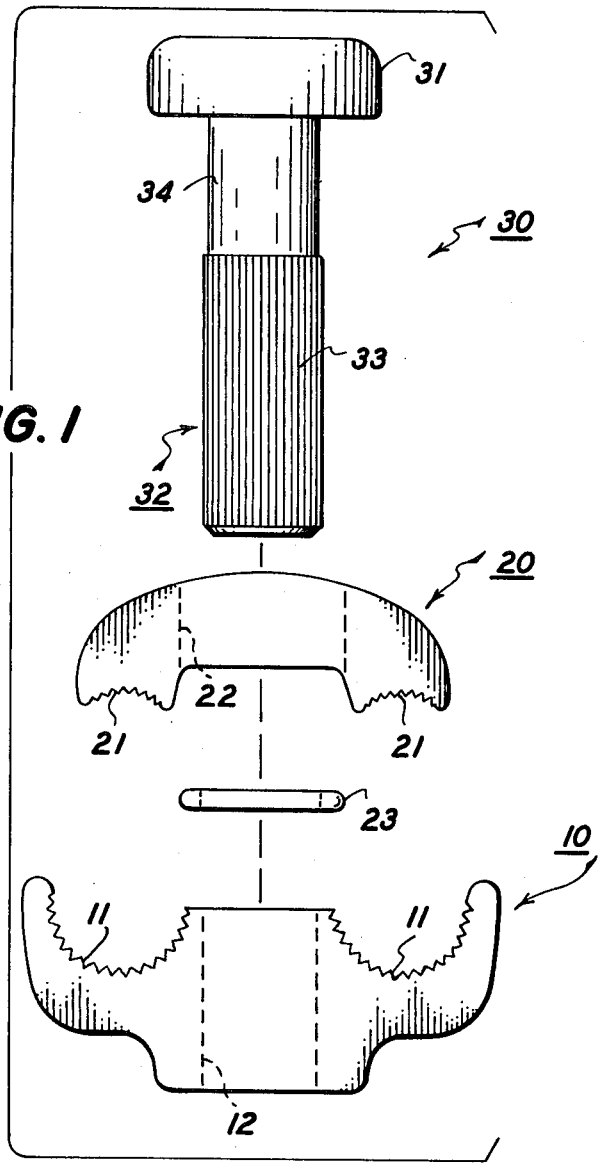
FIG. 1 illustrates an unassembled view of the body, cap and pin means.

Referring more particularly to the drawings, wherein like-referenced numerals have been used throughout to designate like elements, FIG. 1 illustrates schematically one embodiment of the electrical connector. The components of the connector include a first conductor engaging member shown as cap 20, a second conductor engaging member shown as body 10 and a retention member shown as pin 30. These components are assembled together with the conductors during the installation process to make the connection.

The electrical conductors are placed in conductor grooves 11 of body 10. Cap 20 is placed in interacting relationship with the conductors and body 10 so that its conductor grooves 21 also contact the conductor. Body 10 has an aperture or opening 12 through which pin 30 can be driven. Cap 20 also has an aperture or opening 22 to accommodate pin 30. The aperture in the cap can be elongated so that the cap can be self-aligning for different size conductors in one or both of the conductor grooves.

Openings 12 and 22 in body 10 and cap 20, respectively, are located to align themselves when the cap and body are placed together to support the conductors. Conductor grooves 11 and 21 are shown in this embodiment as having a tooth-like shape which makes intimate contact with the conductors. However, the surface of the conductor grooves can take on any suitable shape to make contact with the conductors. For instance, alternative shapes would include the triangular-shaped, longitudinal and angular conductor grooves shown in U.S. Pat. No. 4,147,446. The conductor grooves can be shaped so as to accommodate a broad range of conductor sizes.

Pin 30 has head 31 on one end and bonding region 32 on the other end. The two ends are spaced by shank 34. The bonding region of the pin contains a specially shaped periphery 33 which is described in further detail below. In the embodiment shown in FIG. 1, the bonding region of the pin is adapted to have an interference fit with opening 12 of the body and a clearance fit with opening 22 of the cap. The pin head is larger than opening 22.

The pin, cap and body can be made of any suitable material for the purpose being used. For instance, a metal such as 6061 T6 aluminum has been found to be adequate for the purposes of this type of connector. There is an advantage in using the same material for the pin, cap, and body in that the whole connector expands and contracts under varying thermal conditions in the same manner. When aluminum conductors are used as well as an aluminum connector, loosening is less likely to occur since equal coefficients of expansion result in minimizing internal stresses and cold flow of the aluminum conductors is minimized with resulting reductions in residual contact force.

The connector can also be installed onto conductors in any convenient fashion. For instance, the pin can be first assembled into cap 20. Since opening 22 is basically a clearance hole for the pin, the shank and bonding region of the pin can pass through the opening. The shank of the pin can be sized to provide a slight retention force on the cap as it passes into opening 22 so that head 31 seats squarely on top of the cap and the two components stay together in this position until installation is completed.

O-ring 23, shown in FIG. 1, has been found to be useful prior to installation. The pin is placed through the opening of the cap with its head resting on the top of the cap. The O-ring can then be placed on the pin in the bonding region and slipped up to the bottom of the cap. The purpose of the O-ring, although its use is not required, is to keep the pin and cap together prior to completing installation.

The conductors are placed on conductor grooves 11 of the body and the cap and pin placed on top of the conductors. The pin is, at this point, aligned with opening 12 in the body and the bonding region of the pin is placed into the opening in the body with the conductor grooves of the cap and body facing each other. This insertion can be aided by the use of a chamber on the bonding region end of the pin. The pin can be slightly worked into the body opening just enough so that pin, cap, and body assembly stay together until installation is completed.

Figure 2:
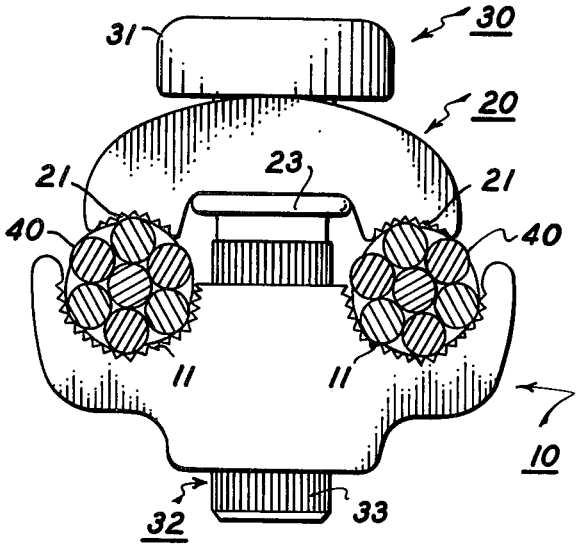
FIG. 2 illustrates a side view of the connector device after it has been installed onto two conductors.
Figure 3:
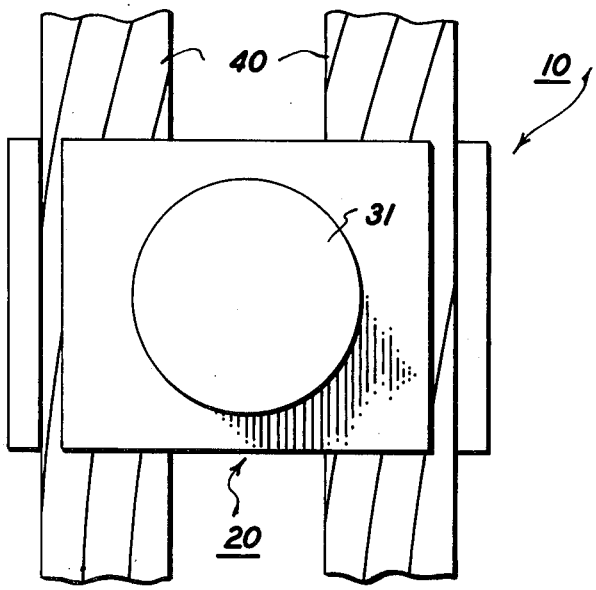
FIG. 3 illustrates a top view of the connector device in FIG. 2.

A driving force is applied to effect installation of the pin. The force, preferably, acts on the pin head and causes the pin to be pressed or fired or otherwise inserted into opening 12 in the body. The pin can be fired, for instance, with relative high velocity, to locate its head squaring on top of and against cap 20. Installation causes at least a portion of the bonding region of the pin to be inserted into the body. A suitable installation tool can be used to press or fire the pin into the body. The tool can be of the hydraulic, explosive or mechanical type, or any other type which can deliver the force required for installation. In its simplest form, the pin can be driven into the body by a hammer to effect installation. FIGS. 2 and 3 show the completely installed connector.

After installation is completed, the pin is bonded to the body and the pin head secures the cap in place relative to the body. Of course, the step of placing the cap and body together before installation need not take place as described above. The conductors can be placed on the body and the cap on the conductors and then the pin placed through the cap and slightly located into the opening in the body. At this point, the pin can be driven through the cap and into the body all in one operation.

The embodiment of the connector shown in the drawings is one adapted to accommodate up to two conductors. Modifications, of course, can be made to the connector. For instance, the connector can be altered to accommodate one or a plurality of conductors with some reshaping of the body and cap for this purpose. Further, the pin can be modified to be bonded to the cap during installation as well as to the body and the pin head eliminated. The pin can also be permanently secured to the cap or formed as an integral part thereof. Additionally, the cap and body can be made as one piece or assembly that can be opened sufficiently, such as like a clam shell, to receive the conductors and then the pin driven into the body and cap to effect installation.

The residual retention force placed on the conductors after installation is important. It is basically provided by the bonding between the pin and body member. The bond is believed to be created, by the formation of a cold weld that results upon the pressing or firing of the pin into the body. The resistance to the passage of electrical current must be kept at a reasonably low level especially in utility applications where high amounts of power are to be carried by the conductors. The resistance force at the connection is inversely proportional to the retention force placed on the cables by the connector. However, there is eventually a point whereat the resistance is not further lowered significantly in response to further increases of application force. Once the retention force is set at an optimum level after installation, any relaxation of it, because of operating environment, tends to raise the resistance level.

There are a number of environmental aspects which can lower the retention force on the connection. For instance, the retention force can be lowered because of thermal expansion of the materials in the connector during current overloads, vibration, mechanical working of the materials, etc. Connections of this type are generally installed and left for a long period of time. By providing a reliably retention force on the conductors coupled with good contact topography between the connector and conductor, maintenance is more likely to be kept to a minimum.

A high, strong, reliable retention force is provided in the connector disclosed herein by the bond created between the bonding region of the pin and the body of the connector. The bonding region on the pin makes an interference fit with aperture 12 and the pin is driven into the aperture until the pin head holds the cap and body against the conductors with a suitable residual retention force.

The bonding region of the pin has a series of grooves and lands which assure the desired retention force. The bonding region, in the embodiment shown in the Figures, has a substantially round cross-section. Its surface has grooves placed thereon by any suitable process such by knurling. The bonding region can also be created by other known processes such as scribing, broaching, heading, molding, extruding, etc. The pin can be manufactured with the shank initially extending all the way from the head. Then, the bonding region can be created by knurling the end of the shank. The knurling process actually increases the diameter of the pin in the area it is applied due to the relocation of metal. Upon complete manufacture, the bonding region has a diameter as measured over the tops of the knurl which is greater than the shank.

The grooves shown in this embodiment are substantially parallel to the length of the pin. However, the grooves can be made in any suitable design and manner. For instance, they can take a non-parallel orientation to form a diamond, spiral, diagonal, etc. configurations on the pin.

Figure 1A:
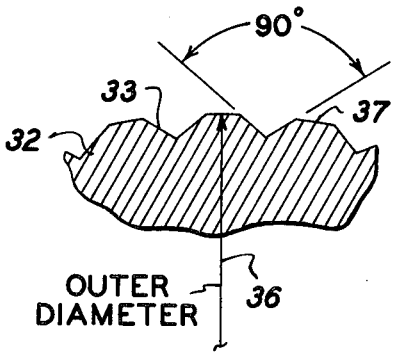
FIG. 1*a* illustrates a cross-sectional portion of the pin means bonding region.

FIG. 1*a* is an enlarged view of a portion of the cross-section of the bonding region shown in FIG. 1. The surface profile has a series of grooves 33 and lands 37 formed by knurling the pin. The bonding region of the pin has an outer diameter 36 which is developed by knurling the pin. The profile of the grooves can be any suitable one which allows the pin to bond itself with a resultant high retention force when placed into the body member. The profile shown in this embodiment is a V-shaped groove which has an angle of about 90 degrees.

The bonding between the pin and body is believed to be a cold weld. This is a solid-phase welding process in which pressure, without added heat, is used to cause interfacial deformation which brings the atoms of the mating surfaces close enough together so that cohesion of both surfaces occurs. It is believed that the lands on the pin permanently deformed during the installation process and, thus, the material of the pin must not be so flexible as to resist this action.

Samples of parallel grooved pin connectors of the type described herein were tested and examined. It was found that the push out force; ie., the force required to push the pin out of the body after installation, was much higher than expected in the connector size range tested. In addition, the push out force value was more than adequate for the size of conductors used with the connectors. For instance, for a nominal ⅜ inch diameter size pin, the push-out force was found to be between about 4500 and 6000 lbs.

The interface between the pin and body was also examined after bonding occurred as a result of installation. The mated pin and body was metallographically sectioned exposing a portion of the bonded pin-body interface. The section was metallographically polished and then etched with Keller's etch and magnified to 100 times magnification. The bond interface was found not to have an interfacial line or separation between the pin and body. The absence of such a line is indicative that a cold weld has occurred to bond the pin to the body.

The material used in the connectors tested and examined was aluminum. Other suitable materials may be used for the connectors which are capable of cold welding. In addition, the pin and body need not be made of the same material as long as the bonding process occurs to create the retention force required. It is believed, though, that the overall retention ability of the connector is better when both are made of the same material.

The cold welding process depends on the intimacy of contact between the surfaces at the pin to body interface so that the atoms bond. Aluminum, for instance, is susceptible to surface oxides and the oxidized surface should be cracked and the underlying metal exposed to the other part, to which it is to be bonded, to have good bonding results.

It is not known to what extent the cold welding occurs between the pin and body, especially when a knurled pin is used. It is clear, however, that some welding takes place and it greatly strengthens the connector. In addition to the selection of materials, other factors that are believed to affect the bonding process are the velocity and application force under which the pin is fired into the body and the smoothness of the surface of the parts. Further factors affecting the bond include the geometric profile of the surfaces to be bonded, the amount of interference between the pin and opening and the amount of preset, or degree of insertion, of the pin in the opening of the body before installation.

Whether or not a lubricant is applied to the pin before pressing or firing it into the body is also believed to be a factor in the bond created. The existence of a lubricant eases the passage of the pin into the opening and lessens the amount of surface contact between the pin and body. It would seem that the use of a lubricant tends to retard the bonding process. However, when a lubricant was used in the assembly of the device disclosed herein, the resulting bond was quite strong and was sufficiently adequate to use the device as intended. Since the use of a lubricant enables the pin to be more easily inserted, it is an aspect which can be balanced against the resulting strength of the bond desired after installation.

It has been found that pins having both shanks and bonding regions larger than the size of aperture 12 provide a high, reliable retention force which subsists over adverse operating conditions for long durations. The knurled pin has been found to provide optimum residual retention force on the conductor over similated long-term operating conditions.

Certain relationships between the banding region's outer diameter, shank diameter and aperture size also enhance optimum retention force. For example, a pin having a nominal size of ⅜" diameter has produced optimum or preferential retention forces on the conductors and required high push-out forces when the following sizing is followed. The shank of the pin is made between about 0.376 and 0.377 inches and a 33 pitch knurl is placed on it in the bonding region. The knurl crest, or land 37, is controlled to be between about 0.009 and 0.014 inches.

After knurling, the outer diameter of the bonding region is between about 0.382 and 0.383 inches. The aperture in the body is between about 0.374 and 0.375 inches when ⅜ inch nominal size pin is used.

This results in a range of interference relationships between the pin and body opening. The least interference fit between the pin and opening (maximum opening/minimum bonding region) is 0.007 inches while the greatest interference fit between the pin and opening (minimum opening/maximum bonding region) is 0.009 inches. The least size difference between the shank (from which the knurl is developed) and opening (maximum opening/minimum shank) is 0.001 inches while the greatest size difference (minimum opening-/maximum shank) is 0.003 inches.

The pin material can be of any suitable type enabling it to perform in the manner desired. It can be relatively conductive and relatively non-flexible. The manner in which the pin provides the high strength, cold weld bond is not fully understood, however, it is believed that the presence of the lands and the relationships between the shank, bonding region and aperture sizes play a role. It is believed that the lands produced by the knurl in the bonding region tend to flow and change shape as the pin is being pressed or fired into the aperture. The surface profile of the bonding region is permanently altered or deformed to provide good interfacing between the aperture wall and pin after the interference fit is completed. This, in turn, enhances the cold welding process and increases the retention force on the connector. The compression force on the conductors is at a high level initially upon installation and remains so throughout the lifetime of the connection.

The overall connector design shown in the figures is such as to provide a constant force on the two conductors held thereby. The pin is approximately centrally-located and the cap and body extend outwardly from the pin to apply force onto the conductors. The design enables a spring action on the conductors since the load force (pin) is centrally applied while the reaction forces (conductor grooves) are at a distance from the pin. As the device expands and contracts due to thermal conditions, a spring-like action is provided so that residual forces are properly maintained on the conductors.

It should be understood that the foregoing is only illustrative of the invention. The various alternatives and modifications in the structural and functional features of the connector device can be devised by those skilled in the art without departing from the invention. Accordingly, the present invention is intended to embrace all such alternatives, modifications and variations which fall within the spirit and scope of the appended claims.

What is claimed is:

1. An electrical connector device for connecting two electrical conductors comprising:

(a) a first electrically conducting conductor engaging member, (b) a second electrically conducting conductor engaging member interactible with the first member for supporting the conductors, the second member having an aperture therein, and (c) pin means inserted into the aperture of the second member for retaining the first and second member together, the pin means on one end thereof having a cross-section larger than the aperture and a surface profile containing lands which permanently deform as the pin means is driven into the aperture of the second member, to produce a solid phase bonding between the surfaces at the pin to second conductor interface and thereby support the second member and electrical conductors with a retention force, and on the other end thereof means for retaining the first member together with the conductors and second member after the one end is driven into the aperture of the second member.

2. The device as in claim 1 wherein the pin means is conductive.

3. The device as in claim 1 wherein the pin means is non-flexible.

4. The device as in claim 1 wherein the first and second members and pin means are metal.

5. The device as in claim 1 wherein the first and second members and pin means are aluminum.

6. The device as in claim 1 wherein the cross-section of the aperture is substantially round and the cross-section of the one end of the pin means is substantially round and has grooves in its periphery which form lands therebetween, the diameter of the one end, as measured across the lands, being larger than the diameter of the aperture of the second member.

7. The device as in claim 6 wherein the grooves are substantially parallel to the length of the pin means.

8. The device as in claim 6 wherein the grooves are substantially V-shaped.

9. The device as in claim 1 wherein the first member has an aperture therein and the pin means has a head on the other end thereof which is larger than the aperture of the first member.

10. An electrical connector device for connecting electrical conductors comprising first, electrically conducting conductor engaging member for retaining one or more conductors having pin means assembled thereto, second electrically conducting conductor engaging member interactible with the first member having an aperture therein, the pin means being larger than the aperture whereby the pin means makes an interference fit with the second member the interference fit being of sufficient magnitude to produce a solid phase bonding between the surfaces at the pin to second conductor interface, and the surface portion of the pin means having a profile including lands which are permanently altered as the pin means is inserted into the aperture whereby a high retention force is created to hold the first and second members and conductor together after installation of the pin means into the second member.

11. An electrical connector device for connecting electrical conductors comprising:

(a) electrically conducting body means for engaging at least one conductor, the body means having an aperture, therein, (b) electrically conducting cap means interactible with the body means engaging the conductor, the cap means, having an aperture therein, the body means and cap means interacting to place a compression force on the conductor when they are engaged therewith and (c) non-flexible pin means insertable in the apertures of the cap means and the body means for holding the cap means, body means and conductors together by a solid phase bonding between the surface at the pin means to body means interface thereby maintaining a predetermined compression force on the conductor by the body means and the cap means after engagement therewith.

12. The device as in claim 11 wherein the pin means is electrically conductive.

13. The device as in claim 11 wherein the aperture of the cap means is larger than the pin means, the pin means having a head larger than the cap means aperture which is locatable against the cap means so as to hold the cap means on the conductor and adjacent body means after the pin means is inserted through the cap means aperture and into the aperture of the body means.

14. The device as in claim 13 wherein the pin means cross-section has an outside diameter larger than the aperture of the body means, the outer diameter containing grooves with lands therebetween, the lands being permanently deformed after the pin means is inserted into the aperture of the body means.

15. The device as in claim 14 wherein the grooves are substantially parallel to the length of the pin means.

16. The device as in claim 15 wherein the cap means and body means have tooth means for engaging the conductor.

17. The device as in claim 14 wherein the pin means has a shank and bonding region and the sizes of the aperture of the body means and bonding region have a relationship to provide optimum retention force on the device after it has been installed on the conductors.

18. A electrical connector device for connecting electrical conductors such as electrical cables comprising:

(a) electrically conducting body member for engaging the conductor, the body means having an opening therein, (b) electrically conducting cap member for engaging the conductor adjacent the body means, the cap means having a clearance opening therein, and (c) pin means with a bonding region, shank and head, the bonding region making an interference fit with the opening in the body means, the bonding region and shank making a clearance fit with the opening in the cap means, and the head being larger than the clearance opening in the cap member, the bonding region having an outer surface which is knurled along the length thereof and having a diameter larger than the opening in the body member whereby the portions of the bonding region surface permanently deform and form a solid phase bonding between the surfaces at the outer surface of the bonding region to body means interface when the pin is inserted into the body member opening through the cap member to thereby provide optimum retention force on the device when fully installed on the conductors.

19. An electrically conductive connector device for connecting first and second electrically conductive members together onto conductors with a residual retention force comprising:

(a) an aperture in the first member, and (b) pin means for retaining the first and second members and conductors together with a retention force, the pin means on one end thereof having a cross-section larger than the aperture and a surface profile containing lands which permanently deform as the pin means is driven into the aperture of the second member, the pin means forming a cold weld with the aperture in the first member after being installed thereon by the formation of a solid phase bonding between the surfaces at the pin means to second member interface, and on the other end thereof means for retaining the first member together with the conductors and second member after the one end is driven into the aperture of the second member.

20. An electrical connector device for connecting two electrical conductors comprising:

(a) first electrically conducting conductor engaging member, (b) second electrical conducting conductor engaging member interactible with the first member for supporting the conductors, the second member having an aperture therein, and (c) pin means for retaining the first and second members together to support the conductors with a retention force, the pin means on one end thereof having a cross-section larger than the aperture and a surface profile containing lands which permanently deform and bond the pin means to the second member by cold welding as the pin means is installed into the aperture of the second member thereby forming a solid phase bonding between the surfaces at the pin means to second member interface and on the other end thereof means for retaining the first member together with the conductors and second member after the one end is driven into the aperture of the second member.

21. A method of making an electrical connection comprising:

(a) placing an electrical conductor between two electrically conducting conductor engaging members, at least one of which has an aperture therein, (b) inserting a pin means having a surface profile with lands thereon into the aperture, the pin means enabled to retain the other member and (c) firing the pin means into the aperture to produce a cold weld between the lands on the pin means and the one member having the aperture whereby a solid phase bonding is obtained between the surfaces at the pin means to the other member interface and the conductor is thereby held between the two members with a high retention force.

22. A method of making an electrical connection comprising:

(a) placing an electrical conductor between two electrically conducting conductor engaging members, at least one of which has an aperture therein, (b) inserting a pin means into the aperture, the pin means enabled to retain the other member, and (c) cold welding the pin means to the aperture to produce a solid phase bonding between the surfaces at the pin means to the other member interface and thereby create a strong bond between the pin means and the one member having the aperture whereby the conductor is held between the two members with a high retention force.

* * * * *